US005631123A

United States Patent [19]

Abe

[11] Patent Number: 5,631,123

[45] Date of Patent: May 20, 1997

[54] SILVER HALIDE COLOR PHOTOGRAPHIC MATERIAL

[75] Inventor: Ryuji Abe, Kanagawa, Japan

[73] Assignee: Fuji Photo Film Co., Ltd., Kanagawa, Japan

[21] Appl. No.: 419,537

[22] Filed: Apr. 10, 1995

[30] Foreign Application Priority Data

Apr. 14, 1994 [JP] Japan ..... 6-075917

[51] Int. Cl.[6] ..... G03C 1/46

[52] U.S. Cl. ..... 430/506; 430/567; 430/569; 430/604; 430/605

[58] Field of Search ..... 430/506, 503, 430/567, 564, 569, 605, 604

[56] References Cited

U.S. PATENT DOCUMENTS

| | | | |
|---|---|---|---|
| T979,001 | 2/1979 | Graham | 96/74 |
| 4,617,259 | 10/1986 | Ogawa et al. | 430/605 |
| 4,626,498 | 12/1986 | Shuto et al. | 430/379 |
| 4,814,263 | 3/1989 | Hine | 430/567 |
| 4,933,272 | 6/1990 | McDugle et al. | 430/605 |
| 5,206,132 | 4/1993 | Mitsuhashi | 430/567 |
| 5,437,968 | 8/1995 | Nagaoka | 430/505 |

FOREIGN PATENT DOCUMENTS

| | | |
|---|---|---|
| 60-126652 | 6/1985 | Japan . |
| 2110539 | 4/1990 | Japan . |
| 3226732 | 10/1991 | Japan . |

*Primary Examiner*—Geraldine Letscher

*Attorney, Agent, or Firm*—Sughrue, Mion, Zinn, Macpeak & Seas

[57] ABSTRACT

A silver halide color photographic material is disclosed, which comprises a support having provided thereon at least one blue-sensitive emulsion layer, at least one green-sensitive emulsion layer and at least one red-sensitive emulsion layer, wherein at least one emulsion layer in any one of color-sensitive layers contains a silver halide grain having incorporated therein a rhodium ion and the emulsion layer or a layer adjacent to the emulsion layer contains a silver halide emulsion with at least one of the inside and/or surface of substantially light-insensitive grains being fogged or colloidal silver.

5 Claims, No Drawings

SILVER HALIDE COLOR PHOTOGRAPHIC MATERIAL

FIELD OF THE INVENTION

The present invention relates to a silver halide color photographic material, more specifically, to a silver halide color photographic material excellent in color reproducibility and also in processing stability.

BACKGROUND OF THE INVENTION

The color reversal photographic material is demanded to provide excellent image quality the same as in a color negative photographic material.

As a means for improving the image quality, known is the method of adding a light-insensitive silver halide grain or colloidal silver to a light-sensitive emulsion layer and/or to a layer adjacent to the light-sensitive layer. For example, JP-A-51-128528 (corresponding to U.S. Pat. No. 4,082,553, the term "JP-A" as used herein means an "unexamined published Japanese patent application") describes a color reversal photographic material comprising a silver halide emulsion layer containing a silver halide grain with the surface being fogged to improve the interlayer effect. Further, JP-A-60-126652, JP-A-63-304252, JP-A-2-110539, JP-A-3-113438 and U.S. Pat. No. T979,001 describe a light sensitive material in which colloidal silver is incorporated to an emulsion layer or a layer adjacent thereto. However, although these patents surely realize the improvement in image quality, the following problems are still in need to be solved.

The color reversal photographic material is usually processed as follows.

An imagewise exposed color reversal photographic material is processed with a black-and-white negative developer called "first developer". The first developer usually contains a silver halide solvent such as rhodanate and sulfite and the development is a solution physical development. Then, silver halide grains which are neither exposed nor developed with the first developer are optically or chemically fogged and processed with a color developer called "second developer" to form a color positive image. Thereafter, the developed silver in the photographic material is bleached and fixed to provide a color reversal image.

In such a processing, it is well known that the solution physical development of light-sensitive silver halide grains at the first development is accelerated by adding silver halide with the light-insensitive surface or inside thereof being fogged or colloidal silver to a light-sensitive emulsion layer or a layer adjacent thereto. This means that the grain becomes susceptible to fluctuation in the rhodanate or sulfite content in the first developer, and this is verified in fact.

At city processing laboratories, the composition of developer is not always constant among laboratories and even in the same laboratory, the developer is in fact not controlled to have the composition in a constant range.

Accordingly, using the above-described photographic material greatly susceptible to the developer composition, a stable image can hardly be provided to users.

Under these circumstances, a photographic material capable of providing excellent image quality and processing stability has been demanded.

SUMMARY OF THE INVENTION

The object of the present invention is to provide a silver halide color photographic material having superior. color reproducibility and good processing stability.

The above-described object has been achieved by:

(1) a silver halide color photographic material comprising a support having provided thereon at least one blue-sensitive emulsion layer, at least one green-sensitive emulsion layer and at least one red-sensitive emulsion layer, wherein at least one emulsion layer in any one of color-sensitive layers contains a silver halide grain having incorporated therein a rhodium ion and the emulsion layer or a layer adjacent to the emulsion layer contains a silver halide emulsion with at least one of the inside and/or surface of substantially light-insensitive grains being fogged or colloidal silver;

(2) the silver halide color photographic material as in item (1), wherein the layer containing a silver halide grain having incorporated therein a rhodium ion and containing a silver halide emulsion with at least one of the inside and/or surface of substantially light-insensitive grains being fogged or colloidal silver is the lowest-sensitivity emulsion layer in the color-sensitive layer, or the layer containing a silver halide emulsion with at least one of the inside and/or surface of substantially light-insensitive grains being fogged or colloidal silver is provided adjacent to the lowest-sensitivity emulsion layer in the color-sensitive layer;

(3) the silver halide color photographic material as in item (1), wherein the silver halide emulsion with at least one of the inside and/or surface of substantially light-insensitive grains being fogged or colloidal silver is colloidal silver having a maximum absorption wavelength of from 400 nm to 500 nm;

(4) the silver halide color photographic material as in item (1), wherein the blue-sensitive emulsion layer, the green-sensitive emulsion layer and the red-sensitive emulsion layer each is composed of at least three emulsion layers having different sensitivities; and (5) a method for forming a silver halide color photographic image comprising a processing of the silver halide color photographic material of items (1) to (4) with a developer containing thiocyanate.

DETAILED DESCRIPTION OF THE INVENTION

The present invention will be described below in detail.

In the present invention, the layer containing a silver halide emulsion with at least one of the inside or the surface of substantially light-insensitive grains being fogged or colloidal silver is preferably provided adjacent to at least one of the blue-sensitive, green-sensitive and red-sensitive layers. If the silver halide emulsion with at least one of the inside or the surface of substantially light-insensitive grains being fogged or colloidal silver is incorporated into the high-sensitivity light-sensitive layer, the developer composition becomes of great influence and causes serious damage such as that the photographic material may undergo the formation of unnecessary fog during storage or development. On the other hand, if the silver halide emulsion with at least one of the inside or the surface of substantially light-insensitive grains being fogged or colloidal silver is incorporated into a layer not adjacent to a color-sensitive layer, for example, with an interlayer intervening therebetween, the color reproducibility is deteriorated.

In the present invention, when the blue-sensitive emulsion layer, the green-sensitive emulsion layer and the red-sensitive emulsion layers each is composed of two or more layers having different sensitivities or spectral sensitivities, the silver halide emulsion with at least one of the inside or the surface of substantially light-insensitive grains being fogged or colloidal silver is very preferably incorporated into the layer adjacent to the lowest-sensitivity layer of each color-sensitive layer.

The above-described effects can be very prominently exerted when the blue-sensitive emulsion layer, the green-sensitive emulsion layer and the red-sensitive emulsion layer all are composed of three or more layers having different sensitivities.

The silver halide grain having incorporated therein a rhodium ion according to the present invention will be described below.

The rhodium ion is incorporated into the silver halide grain by introducing a rhodium complex (complex salt) thereinto during or after the formation of silver halide grain. The rhodium complex is trivalent rhodium and its ligands are not particularly restricted but at least one of the ligands is preferably bromine.

The above-described rhodium complex can be incorporated into the silver halide grain according to conventional methods. More specifically, at the time when a silver ion solution and an aqueous halogen solution are mixed with stirring to form silver halide grains, an aqueous solution having dissolved therein a complex used in the present invention (in the case when the formed silver halide grain contains bromine, a KBr solution in which the complex is present together may be used) is added to the above-described mixed reaction solution so that the rhodium ion is incorporated into the silver halide grain. Alternatively, the rhodium ion can be incorporated into the grain by adding an aqueous solution of the above-described complex to the reaction solution after the formation of silver halide grains. In this case, the ion may be covered by silver halide.

The amount of rhodium (content) is preferably from $10^{-9}$ to $10^{-2}$ mol, more preferably from $10^{-8}$ to $10^{-2}$ mol, per mol of silver halide.

Metals other than rhodium may be incorporated into the silver halide grain of the present invention. Examples of the metal include metals described in JP-A-1-14647 (e.g., Mn, Cu, Zn, Cd, Pb, Bi, In, Tl, Zr, La, Cr, Re or metals other than rhodium belonging to Group VIII in the Periodic Table). Two or more of these metals may be incorporated into the grain.

These metals can also be incorporated into the silver halide grain according to the same method as the above-described method for incorporating rhodium for use in the present invention. Depending upon the metal incorporated, an organic solvent may be partly used at the preparation of an aqueous solution of the metal. The method for incorporating metals into the silver halide grain is described in U.S. Pat. Nos. 3,761,276 and 4,395,478 and JP-A-59-216136.

The above-described metal which can be used in combination with rhodium is preferably present in the silver halide grain in an amount of from $10^{-9}$ to $10^{-2}$ mol, more preferably from $10^{-7}$ to $10^{-3}$ mol, per mol of silver halide.

The silver halide grain for use in the present invention may have a regular crystal form such as cubic, octahedral, dodecahedral or tetradecahedral form (see JP-A-2-223948) or an irregular crystal form such as sphere, or an emulsion described in JP-A-1-131547 and JP-A-1-158429 may also be used, in which tabular grains having an aspect ratio of 2 or more, particularly 8 or more, accounts for 50% or more of the total projected area of grains. Also, the grain may have a composite form of various crystals or an emulsion composed of a mixture thereof may be used.

The silver halide of the present invention preferably has a composition of silver bromide, silver chloride, silver chlorobromide, silver iodobromide or silver chloroiodobromide. The silver iodobromide is particularly preferred in the present invention.

The average grain size of silver halide grains (an average based on the projected area in the case of a sphere or nearly sphere grain, by taking the diameter and in the case of a cubic grain, the longitudinal length as a grain size) is preferably from 2.0 to 0.07 μm, particularly preferably from 1.2 to 0.1 μm. The grain size distribution may be either narrow or broad, however, a so-called "monodisperse" silver halide emulsion is preferably used for improving granularity or sharpness, which has a narrow grain size distribution such that 90% or more, particularly preferably 95% or more, by grain number or weight, of grains has a grain size within the average grain size ±40%, preferably ±30%, most preferably ±20%.

In order to achieve gradation which the photographic material intends to provide, a plurality of groups of grains each having different grain sizes may be mixed in the same layer or coated on separate layers in emulsion layers having substantially the same color sensitivity. Further, two or more polydisperse silver halide emulsions or combinations of a monodisperse emulsion and a polydisperse emulsion may be mixed in the same layer or coated on separate layers.

Now, the silver halide emulsion with at least one of the inside or the surface of substantially light-insensitive grains being fogged or colloidal silver for use in the present invention will be described in detail.

The silver halide grain with the surface and/or the inside thereof being fogged as used in the present invention means a silver halide grain adjusted by a chemical method or light such that the grain contains in the surface and/or the inside thereof a fogging nucleus and is developable irrespective of exposure.

The silver halide grain with the surface thereof being fogged (surface-fogged silver halide grain) can be prepared by fogging the silver halide grain by a chemical method or light during and/or after the formation of silver halide grain.

The above-described fogging process can be carried out under appropriate pH and pAg conditions, for example, by adding a reducing agent or a gold salt, by heating at a low pAg or by applying uniformexposure. Examples of the reducing agent include stannous chloride, a hydrazine-based compound, ethanolamine and thiourea dioxide.

The fogging by the addition of such a fogging material is preferably carried out before water washing so as to prevent the aging fog due to the diffusion of the fogging material to the light-sensitive emulsion layer.

The silver halide grain with the inside thereof being fogged (inside-fogged silver halide grain) can be prepared by forming a shell on the surface of the above-described surface-fogged silver halide grain used as a core. JP-A-59-214852 describes on such an inside-fogged silver halide grain in detail. The effects of the inside-fogged silver halide grain on sensitization development can be controlled by controlling the shell thickness.

The inside-surface silver halide grain can also be prepared by forming a fogged core according to the above-described fogging method from the starting of grain formation and then attaching an unfogged shell thereto. If desired, the grain may be fogged over all from the inside to the surface.

The fogged silver halide grain may be any of silver chloride, silver bromide, silver chlorobromide, silver iodobromide and silver chloroiodobromide but it is preferably silver bromide or silver iodobromide. The fogged silver halide grain preferably has an iodide content of 5 mol % or less, more preferably 2 mol % or less. The fogged silver halide grain may have a structure wherein the shell of the grain is different in the halogen composition from the core of the grain.

The average grain size of the fogged silver halide grain used in the present invention is not particularly limited, however, when the fogged silver halide grain is added to a light-sensitive silver halide emulsion layer or a light-insensitive layer, it is preferably smaller than the average grain size of silver halide grain in the lowest-sensitivity layer of the adjacent layer. Specifically, it is preferably 0.5 μm or less, more preferably 0.2 μm or less and most preferably 0.1 μm or less.

The crystal form of the fogged silver halide grain is not particularly limited and the grain may be either regular grains or irregular grains. Also, the fogged silver halide grain may be polydisperse but it is preferably monodisperse.

The amount of the fogged silver halide grain used may be freely changed according to the degree of necessity in the present invention, however, in terms of the ratio to the entire amount of light-sensitive silver halide contained in all layers of the color photographic material of the present invention, it is preferably from 0.05 to 50 mol %, more preferably from 0.1 to 25 mol %. In view of the fogging efficiency per silver amount used, the surface fogged silver halide preferably has a smaller average grain size (specifically, 0.2 μm or less).

The colloidal silver used in the present invention will be described below in detail.

The preparation for various types of colloidal silver are described, for example, in Weiser, *Colloidal Elements*, Wiley & Sons, New York, 1933 (yellow colloidal silver by Carey Lea's dextrin reduction method), German Patent No. 1,096,193 (brown and black colloidal silvers) and U.S. Pat. No. 2,688,601 (blue colloidal silver). Among these, yellow colloidal silver having a maximum absorption wavelength of from 400 to 500 nm is particularly preferred.

In the present invention, when the total amount of coated silver of the photographic material is 2 g/m$^2$ or more, fabulous effects are achieved. If the total amount of coated silver is too large, the silver halide emulsion with at least one of the inside or the surface of substantially light-insensitive grains being fogged or colloidal silver cannot exert effects sufficiently and therefore, it is preferably from 3 to 6 g/m$^2$, more preferably from 4 to 6 g/m$^2$.

The silver halide emulsion with at least one of the inside or the surface of substantially light-insensitive grains being fogged or colloidal silver according to the present invention is coated on each layer preferably in an amount of from 0.001 to 0.4 g/m$^2$, more preferably from 0.003 to 0.3 g/m$^2$.

Various techniques and various inorganic and organic materials described in *Research Disclosure* No. 308119 (December, 1989) can be applied to the silver halide photographic emulsion and the silver halide photographic material using the same according to the present invention.

In addition, more specifically, for example, the techniques and inorganic/organic materials which can be used in the color photographic material to which the silver halide photographic emulsion according to the present invention is applied are described in the following portions of EP-A-436938 and in patents described below.

| Item | Pertinent Portion |
|---|---|
| 1) Layer structure | from page 146, line 34 to page 147, line 25 |
| 2) Silver halide emulsion | from page 147, line 26 to page 148, line 12 |
| 3) Yellow coupler | from page 137, line 35 to page 146, line 33 and page 149, lines 21 to 23 |
| 4) Magenta coupler | page 149, lines 24 to 28; EP-A-421453, from page 3, line 5 to page 25, line 55 |
| 5) Cyan coupler | page 149, lines 29 to 33; EP-A-432804, from page 3, line 28 to page 40, line 2 |
| 6) Polymer coupler | page 149, lines 34 to 38; EP-A-435334, from page 113, line 39 to page 123, line 37 |
| 7) Colored coupler | from page 53, line 42 to page 137, line 34 and page 149, lines 39 to 45 |
| 8) Other functional couplers | from page 7, line 1 to page 53, line 41 and from page 149, line 46 to page 150, line 3; EP-A-435334, from page 3, line 1 to page 29, line 50 |
| 9) Antiseptic/antimold | page 150, lines 25 to 28 |
| 10) Formalin scavenger | page 149, lines 15 to 17 |
| 11) Other additives | page 153, lines 38 to 47; EP-A-421453, from page 75, line 21 to page 84, line 56 and from page 27, line 40 to page 37, line 40 |
| 12) Dispersion method | page 150, lines 4 to 24 |
| 13) Support | page 150, lines 32 to 34 |
| 14) Film thickness/ physical properties | page 150, lines 35 to 49 |
| 15) Color development/ black-and-white development, fogging | from page 150, line 50 to page 151, line 47; EP-A-442323, page 34, lines 11 to 54 and page 35, lines 14 to 22 |
| 16) Desilvering | from page 151, line 48 to page 152, line 53 |
| 17) Automatic developer | from page 152, line 54 to page 153, line 2 |
| 18) Water washing/ stabilization | page 153, lines 3 to 37 |

The present invention will now be illustrated in greater detail by reference to the following example. However, the present invention should not to be construed as being limited to the example. Additionally, in the following example, all parts, percents or the like are by weight unless otherwise indicated.

EXAMPLE

Preparation of Sample 101:

A multilayer color photographic material was prepared to have the layers each having the following composition on a 127 μm-thick cellulose triacetate film support having a subbing layer and designated as Sample 101. The numerals indicate the addition amount per m$^2$. The effects of compounds added are not restricted to those described herein.

| First Layer: Antihalation Layer | |
|---|---|
| Black colloidal silver | 0.30 g |
| Gelatin | 2.20 g |
| Ultraviolet ray absorbent U-1 | 0.10 g |
| Ultraviolet ray absorbent U-3 | 0.05 g |
| Ultraviolet ray absorbent U-4 | 0.10 g |
| High boiling point organic solvent Oil-1 | 0.30 g |

-continued

| | |
|---|---|
| Fine crystal solid dispersion of Dye E-1 | 0.10 g |

Second Layer: Interlayer

| | |
|---|---|
| Gelatin | 0.40 g |
| Compound Cpd-I | 7 mg |
| Compound Cpd-J | 3 mg |
| Compound Cpd-K | 3 mg |
| High boiling point organic solvent Oil-3 | 0.10 g |
| Dye D-4 | 9 mg |

Third Layer: Interlayer

| | |
|---|---|
| Gelatin | 0.40 g |

Fourth Layer: Low-sensitivity Red-sensitive Emulsion Layer

| | |
|---|---|
| Emulsion $A_1$ | as silver 0.30 g |
| Gelatin | 0.60 g |
| Coupler C-1 | 0.05 g |
| Coupler C-2 | 0.15 g |
| Coupler C-3 | 0.05 g |
| Compound Cpd-C | 5 mg |
| Compound Cpd-J | 5 mg |
| High boiling point organic solvent Oil-2 | 0.10 g |
| Additive P-1 | 0.10 g |

Fifth Layer: Middle-sensitivity Red-sensitive Emulsion Layer

| | |
|---|---|
| Emulsion B | as silver 0.40 g |
| Emulsion C | as silver 0.10 g |
| Gelatin | 1.50 g |
| Coupler C-1 | 0.10 g |
| Coupler C-2 | 0.30 g |
| Coupler C-3 | 0.10 g |
| High boiling point organic solvent Oil-2 | 0.20 g |
| Additive P-1 | 0.10 g |

Sixth Layer: High-sensitivity Red-sensitivity Emulsion Layer

| | |
|---|---|
| Emulsion D | as silver 0.25 g |
| Emulsion E | as silver 0.25 g |
| Gelatin | 1.00 g |
| Coupler C-1 | 0.15 g |
| Coupler C-2 | 0.40 g |
| Coupler C-3 | 0.15 g |
| Coupler C-9 | 0.10 g |
| Additive P-1 | 0.10 g |

Seventh Layer: Interlayer

| | |
|---|---|
| Gelatin | 1.40 g |
| Additive M-1 | 0.30 g |
| Color mixing inhibitor Cpd-I | 0.03 g |
| Dye D-5 | 5 mg |
| Compound Cpd-J | 5 mg |
| High boiling point organic solvent Oil-1 | 0.02 g |

Eighth Layer: Interlayer

| | |
|---|---|
| Gelatin | 1.20 g |
| Additive P-1 | 0.20 g |
| Color mixing inhibitor Cpd-A | 0.10 g |
| Compound Cpd-C | 0.10 g |

Ninth Layer: Low-sensitivity Green-sensitive Emulsion Layer

| | |
|---|---|
| Emulsion $F_1$ | as silver 0.30 g |
| Gelatin | 0.70 g |
| Coupler C-4 | 0.05 g |
| Coupler C-11 | 0.10 g |
| Coupler C-7 | 0.05 g |
| Coupler C-8 | 0.10 g |
| Compound Cpd-B | 0.03 g |
| Compound Cpd-D | 0.02 g |
| Compound Cpd-E | 0.02 g |
| Compound Cpd-F | 0.04 g |
| Compound Cpd-J | 10 mg |
| Compound Cpd-L | 0.02 g |
| High boiling point organic solvent Oil-1 | 0.10 g |
| High boiling point organic solvent Oil-2 | 0.10 g |

-continued

Tenth Layer: Middle-sensitivity Green-sensitive Emulsion Layer

| | |
|---|---|
| Emulsion G | as silver 0.40 g |
| Emulsion H | as silver 0.10 g |
| Gelatin | 0.60 g |
| Coupler C-4 | 0.05 g |
| Coupler C-11 | 0.15 g |
| Coupler C-7 | 0.05 g |
| Coupler C-8 | 0.10 g |
| Compound Cpd-B | 0.03 g |
| Compound Cpd-D | 0.02 g |
| Compound Cpd-E | 0.02 g |
| Compound Cpd-F | 0.05 g |
| Compound Cpd-L | 0.05 g |
| High boiling point organic solvent Oil-2 | 0.05 g |

Eleventh Layer: High-sensitivity Green-sensitive Emulsin Layer

| | |
|---|---|
| Emulsion I | as silver 0.45 g |
| Emulsion J | as silver 0.40 g |
| Gelatin | 1.40 g |
| Coupler C-4 | 0.15 g |
| Coupler C-11 | 0.20 g |
| Coupler C-7 | 0.10 g |
| Coupler C-8 | 0.20 g |
| Compound Cpd-B | 0.03 g |
| Compound Cpd-E | 0.02 g |
| Compound Cpd-F | 0.04 g |
| Compound Cpd-K | 5 mg |
| Compound Cpd-L | 0.02 g |
| High boiling point organic solvent Oil-1 | 0.05 g |
| High boiling point organic solvent Oil-2 | 0.05 g |

Twelfth Layer: Interlayer

| | |
|---|---|
| Gelatin | 0.30 g |
| Compound Cpd-L | 0.05 g |
| High boiling point organic solvent Oil-1 | 0.05 g |

Thirteenth Layer: Yellow Filter Layer

| | |
|---|---|
| Yellow colloidal silver | as silver 0.10 g |
| Gelatin | 0.90 g |
| Color mixing inhibitor Cpd-A | 0.01 g |
| Compound Cpd-L | 0.01 g |
| High boiling point organic solvent Oil-1 | 0.01 g |
| Fine crystal solid dispersion of Dye E-2 | 0.05 g |

Fourteenth Layer: Interlayer

| | |
|---|---|
| Gelatin | 0.6 g |

Fifteenth Layer: Low-sensitivity Blue-sensitive Emulsion Layer

| | |
|---|---|
| Emulsion $K_1$ | as silver 0.4 g |
| Gelatin | 1.40 g |
| Coupler C-5 | 0.20 g |
| Coupler C-6 | 0.10 g |
| Coupler C-10 | 0.10 g |

Sixteenth Layer: Middle-sensitivity Blue-sensitive Emulsion Layer

| | |
|---|---|
| Emulsion L | as silver 0.15 g |
| Emulsion M | as silver 0.10 g |
| Gelatin | 0.90 g |
| Coupler C-5 | 0.20 g |
| Coupler C-6 | 0.05 g |
| Coupler C-10 | 0.10 g |

Seventeenth Layer: High-sensitivity Blue-sensitive Emulsion Layer

| | |
|---|---|
| Emulsion M | as silver 0.10 g |
| Emulsion N | as silver 0.15 g |
| Emulsion O | as silver 0.20 g |
| Gelatin | 1.50 g |
| Coupler C-5 | 0.35 g |
| Coupler C-6 | 0.10 g |
| Coupler C-10 | 0.60 g |
| High boiling point organic solvent Oil-2 | 0.10 g |

-continued

| Eighteenth Layer: First Protective Layer | |
|---|---|
| Gelatin | 1.70 g |
| Ultraviolet ray absorbent U-1 | 0.20 g |
| Ultraviolet ray absorbent U-2 | 0.05 g |
| Ultraviolet ray absorbent U-5 | 0.30 g |
| Formalin scavenger Cpd-H | 0.40 g |
| Dye D-1 | 0.15 g |
| Dye D-2 | 0.05 g |
| Dye D-3 | 0.10 g |
| Nineteenth Layer: Second Protective Layer | |
| Colloidal silver | as silver 0.1 mg |
| Fine grain silver iodobromide emulsion (average grain size: 0.06 μm, AgI content: 1 mol %) | as silver 0.10 g |
| Gelatin | 0.60 g |
| Twentieth Layer: Third Protective Layer | |
| Gelatin | 1.30 g |
| Polymethyl methacrylate (average grain size: 1.5 μm) | 0.10 g |
| Copolymer of methyl methacrylate and acrylic acid (4:6) (average grain size: 1.5 μm) | 0.10 g |
| Silicone oil | 0.03 g |
| Surfactant W-1 | 3.0 mg |
| Surfactant W-2 | 0.03 g |

The colloidal silver used in the nineteenth layer was prepared in the same manner as in the present invention. However, the nineteenth layer is not a layer adjacent to any emulsion layer containing a silver halide grain having incorporated therein a rhodium ion. Accordingly, Sample 101 falls outside the scope of the present invention.

In addition to the above-described composition, additives F-1 to F-8 were added to each emulsion layer. Also, in addition to the above-described composition, gelatin hardener H-1 and surfactants W-3, W-4, W-5 and W-6 for coating or emulsification were added to each layer.

Further, phenol, 1,2-benzisothiazoline-3-one, 2-phenoxyethanol, phenetyl alcohol or p-butyl benzoate were added as an antiseptic or an antimold.

TABLE 1

Silver Iodobromide Emulsion used in Sample 101

| Emulsion | Characteristics of Grain | Sphere-corresponding Average Grain size (μm) | Coefficient of Fluctuation (%) | AgI Content (%) |
|---|---|---|---|---|
| $A_1$ | monodisperse cubic grain | 0.10 | 11 | 4.5 |
| B | monodisperse cubic grain | 0.19 | 14 | 4.5 |
| C | monodisperse cubic grain | 0.31 | 16 | 4.5 |
| D | polydisperse tabular grain, average aspect ratio: 6.0 | 0.60 | 28 | 4.5 |
| E | polydisperse tabular grain, average aspect ratio: 6.3 | 0.90 | 29 | 4.5 |
| $F_1$ | monodisperse cubic grain | 0.10 | 11 | 2.0 |
| G | monodisperse cubic grain | 0.18 | 14 | 4.7 |
| H | monodisperse cubic grain | 0.40 | 17 | 4.7 |
| I | polydisperse tabular grain, average aspect ratio: 6.0 | 0.65 | 25 | 4.0 |
| J | monodisperse tabular grain, average aspect ratio: 4.5 | 1.05 | 18 | 3.0 |
| $K_1$ | monodisperse cubic grain | 0.15 | 15 | 2.0 |
| L | monodisperse cubic grain | 0.20 | 17 | 2.0 |
| M | monodisperse cubic grain | 0.34 | 17 | 2.0 |
| N | polydisperse tabular grain, average aspect ratio: 6.0 | 0.65 | 28 | 2.0 |
| O | polydisperse internal high iodide-type twin crystal grain | 1.70 | 33 | 2.0 |

TABLE 2

Spectral Sensitization of Emulsions A to O

| Emulsion | Sensitizing Dye Added | Addition Amount per mol of Silver Halide (g) |
|---|---|---|
| $A_1$ | S-1 | 0.30 |
| | S-2 | 0.10 |
| B | S-1 | 0.26 |
| | S-2 | 0.26 |
| C | S-1 | 0.24 |
| | S-2 | 0.24 |
| D | S-1 | 0.15 |
| | S-2 | 0.15 |
| E | S-1 | 0.11 |
| | S-2 | 0.03 |
| $F_1$ | S-3 | 0.97 |
| G | S-3 | 0.50 |
| H | S-3 | 0.36 |
| I | S-3 | 0.43 |
| J | S-3 | 0.36 |
| $K_1$ | S-4 | 0.30 |
| L | S-4 | 0.28 |
| M | S-4 | 0.14 |
| N | S-4 | 0.21 |
| O | S-4 | 0.27 |

C-1
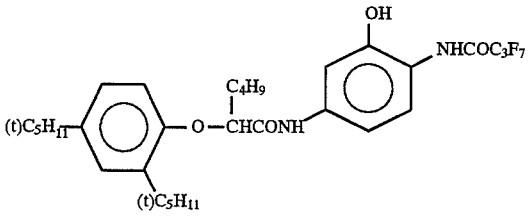
C-2
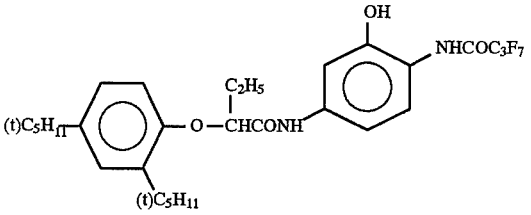
C-3
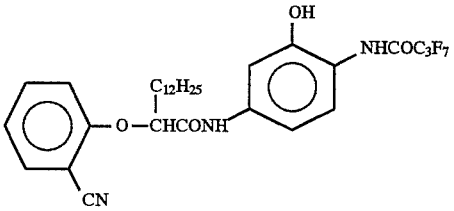
C-4
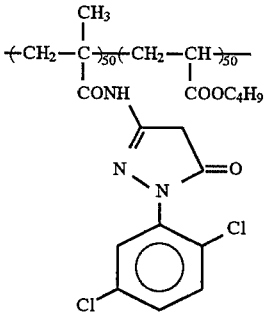
Numerals are by wt %
Average molecular weight:
about 25,000
C-5
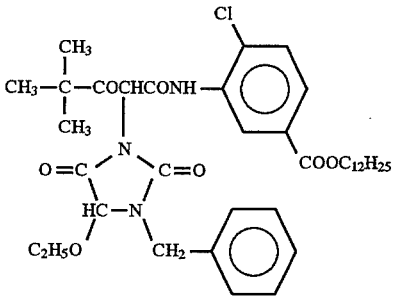
C-6
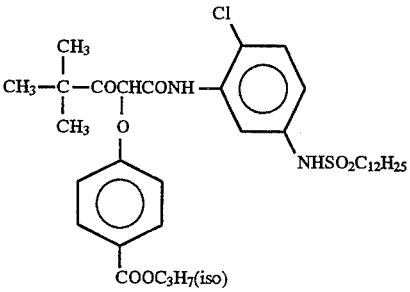

-continued
C-7
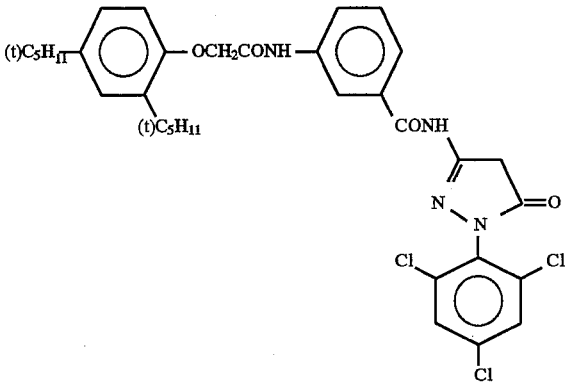
C-8
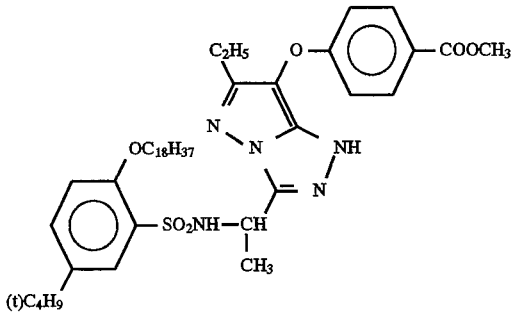
C-9
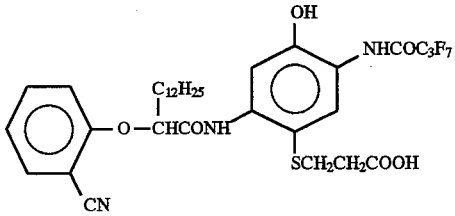
C-10
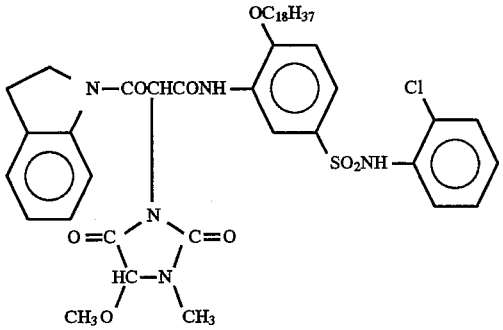
C-11
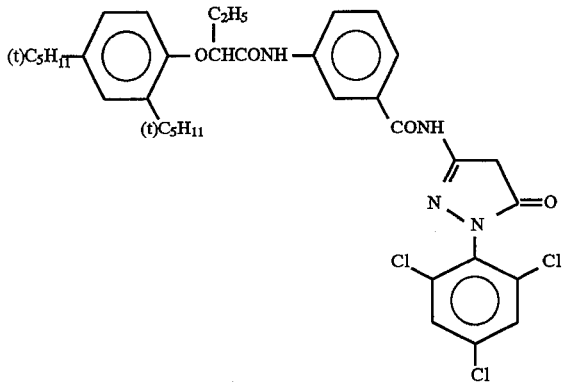
Dibutyl phthalate Oil-1

-continued
Tricresyl phosphate — Oil-2
Oil-3
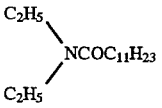
Cpd-A
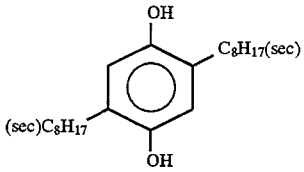
Cpd-B
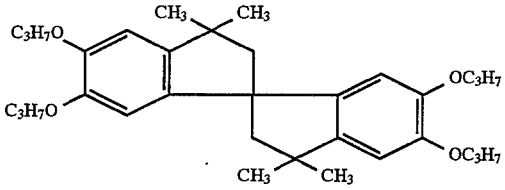
Cpd-C
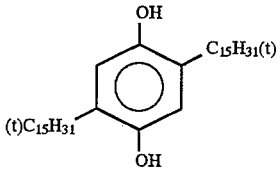
Cpd-D
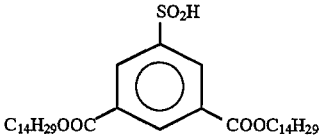
Cpd-E
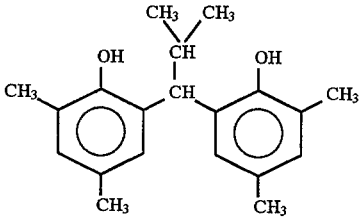
Cpd-F
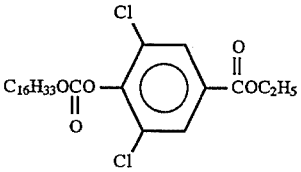
Cpd-H
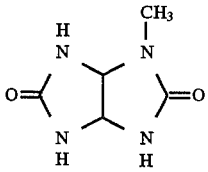
Cpd-I
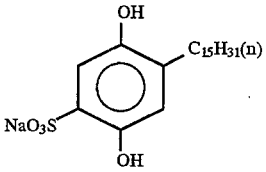

-continued
Cpd-J
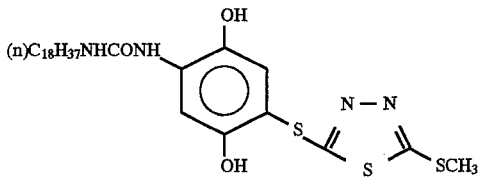
Cpd-K
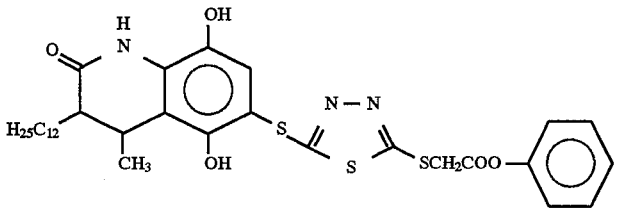
Cpd-L
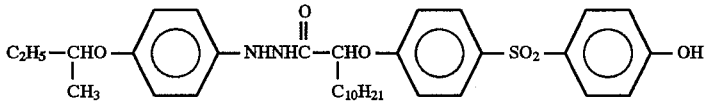
U-1
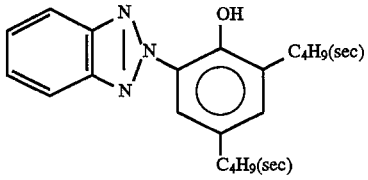
U-2
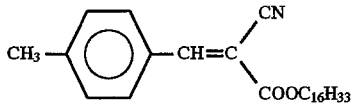
U-3
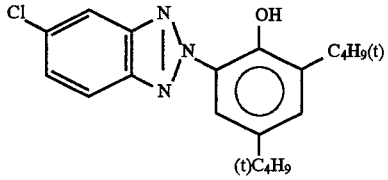
U-4
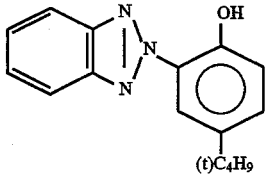
U-5
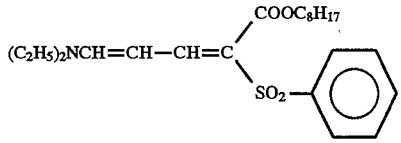
D-1
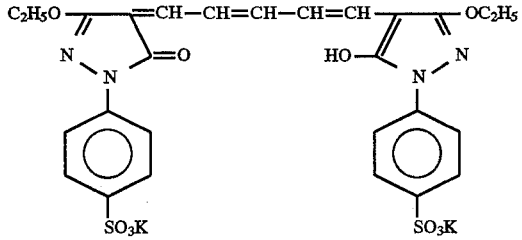

-continued
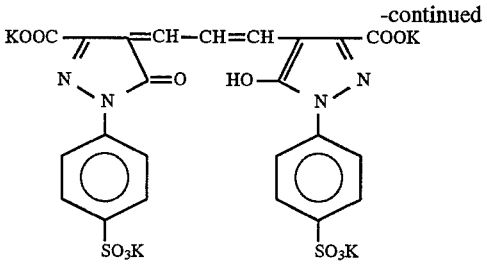
D-2
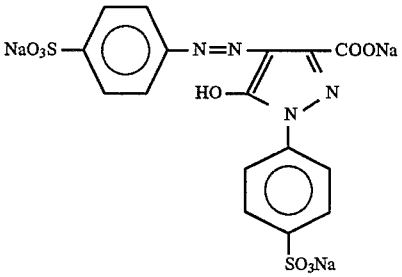
D-3
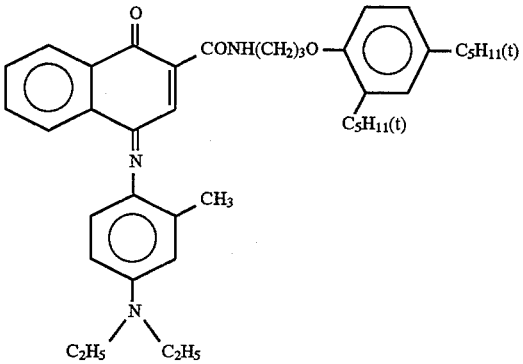
D-4
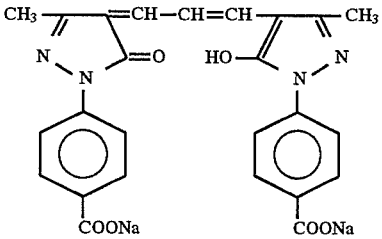
D-5
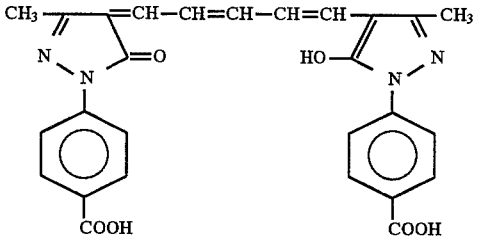
E-1
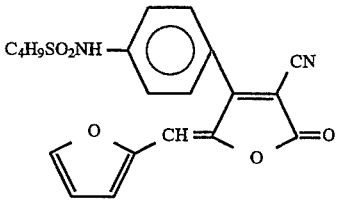
E-2
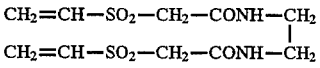
H-1

-continued
$C_8F_{17}SO_2NHCH_2CH_2CH_2OCH_2CH_2\overset{\oplus}{N}(CH_3)_3$ W-1
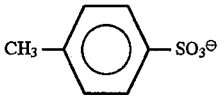
$C_8F_{17}SO_2N(C_3H_7)CH_2COOK$ W-2
$NaO_3S-CH(CH_2COOCH_2CH(C_2H_5)C_4H_9)COOCH_2CH(C_2H_5)C_4H_9$ W-3
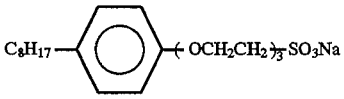
W-4
A mixture of compounds represented by the formula: W-5
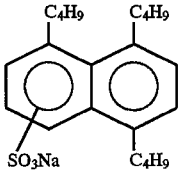
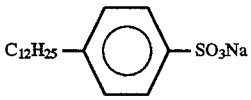
W-6
$\text{-}(CH_2-CH(CONHC_4H_9(t)))_n\text{-}$ P-1
(n = 100–1,000)
$\text{-}(CH_2-CH(COOC_4H_9))_n\text{-}$ M-1
(n = 100–1,000)
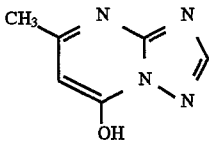
F-1
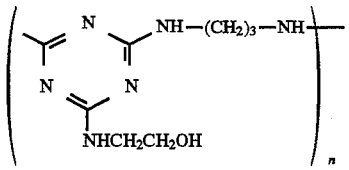
F-2
$-HNO_3$
(n = 2–10)
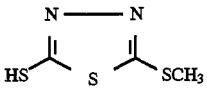
F-3
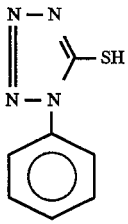
F-4

-continued

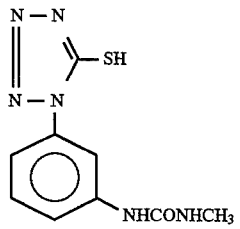

F-5

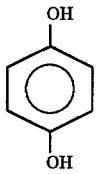

F-6

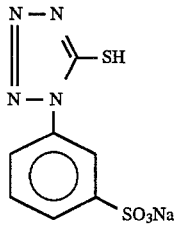

F-7

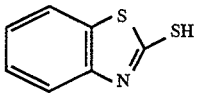

F-8

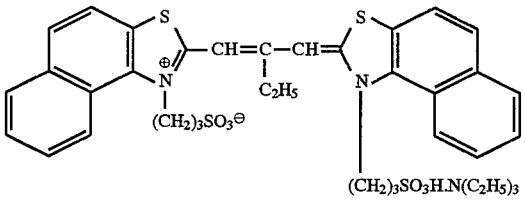

S-1

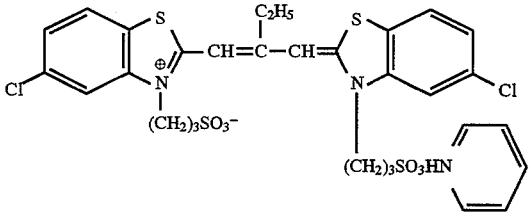

S-2

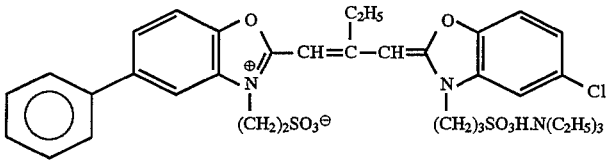

S-3

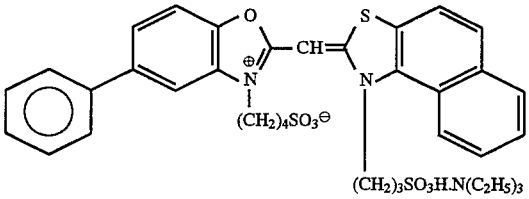

S-4

Preparation of Samples 102 to 125:

Samples 102 to 125 were prepared in the same manner as Sample 101 except for using Emulsions $A_2$, $F_2$ and $K_2$ each having incorporated therein an Rh ion in place of Emulsions A, F and $K_1$ used in Sample 101 and using a fogged emulsion and yellow colloidal silver (maximum absorption wavelength: 450 nm). The characteristics of Emulsions $A_2$, $F_2$ and $K_2$, the fogged emulsion and the yellow colloidal silver are shown in Table 3 and the characteristics of Samples 102 to 125 are shown in Table 4.

TABLE 3

Characteristics of Emulsions $A_2$, $F_2$ and $K_2$, Fogged Emulsion X and Yellow Colloidal Silver Y

| Emulsion | size (μm) | Coefficient of Fluctuation (%) | Rh Ion (mol/mol-Ag) | Sensitizing Dye (g/mol-Ag) | Remarks |
|---|---|---|---|---|---|
| $A_2$ | 0.18 | 12 | $3.6 \times 10^{-7}$ | S-1 0.17<br>S-2 0.06 | AgI content was the same as in Emulsion $A_1$ |
| $F_2$ | 0.18 | 12 | $3.6 \times 10^{-7}$ | S-3 0.54 | AgI content was the same as in Emulsion $F_1$ |
| $K_2$ | 0.25 | 18 | $3.6 \times 10^{-7}$ | S-4 0.18 | AgI content was the same as in Emulsion $K_1$ |
| X | 0.06 | 13 | none | none | fine grained silver iodobromide emulsion with the surface and the inside thereof being fogged, AgI content: 1 mol % |
| Y | — | — | none | none | yellow colloidal silver, AgI content: 1.0 mol % |

TABLE 4

| Sample | Third Layer, X or Y ($g/m^2$) | Fourth Layer Emulsion $A_1$ or $A_2$ ($g/m^2$) | Fourth Layer X or Y ($g/m^2$) | Eight Layer, X or Y ($g/m^2$) | Ninth Layer Emulsion $F_1$ or $F_2$ ($g/m^2$) | Ninth Layer X or Y ($g/m^2$) | Thirteenth Layer, Y ($g/m^2$) | Fourteenth Layer, Interlayer | Fifteenth Layer Emulsion $K_1$ or $K_2$ ($g/m^2$) | Fifteenth Layer X or Y ($g/m^2$) | Remarks |
|---|---|---|---|---|---|---|---|---|---|---|---|
| 101 | none | $A_1$ (0.30) | none | none | $F_1$ (0.30) | none | (0.30) | provided | $K_1$ (0.40) | none | Comparison |
| 102 | none | $A_1$ (0.30) | none | none | $F_1$ (0.30) | none | (0.30) | omitted | $K_1$ (0.40) | none | Comparison |
| 103 | none | $A_1$ (0.30) | none | none | $F_1$ (0.30) | none | (0.30) | provided | $K_1$ (0.40) | Y (0.008) | Comparison |
| 104 | none | $A_1$ (0.30) | none | none | $F_1$ (0.30) | none | (0.30) | omitted | $K_2$ (0.40) | none | Invention |
| 105 | none | $A_1$ (0.30) | none | none | $F_1$ (0.30) | none | (0.30) | provided | $K_2$ (0.40) | Y (0.008) | Invention |
| 106 | none | $A_1$ (0.30) | none | X (0.05) | $F_1$ (0.30) | none | (0.30) | provided | $K_1$ (0.40) | none | Comparison |
| 107 | none | $A_1$ (0.30) | none | Y (0.05) | $F_1$ (0.30) | none | (0.30) | provided | $K_1$ (0.40) | none | Comparison |
| 108 | none | $A_1$ (0.30) | none | none | $F_1$ (0.30) | X (0.006) | (0.30) | provided | $K_1$ (0.40) | none | Comparison |
| 109 | none | $A_1$ (0.30) | none | none | $F_1$ (0.30) | Y (0.006) | (0.30) | provided | $K_1$ (0.40) | none | Comparison |
| 110 | none | $A_1$ (0.30) | none | X (0.05) | $F_2$ (0.30) | none | (0.30) | provided | $K_1$ (0.40) | none | Invention |
| 111 | none | $A_1$ (0.30) | none | Y (0.05) | $F_2$ (0.30) | none | (0.30) | provided | $K_1$ (0.40) | none | Invention |
| 112 | none | $A_1$ (0.30) | none | none | $F_2$ (0.30) | X (0.006) | (0.30) | provided | $K_1$ (0.40) | none | Invention |
| 113 | none | $A_1$ (0.30) | none | none | $F_2$ (0.30) | Y (0.006) | (0.30) | provided | $K_1$ (0.40) | none | Invention |
| 114 | X (0.05) | $A_1$ (0.30) | none | none | $F_1$ (0.30) | none | (0.30) | provided | $K_1$ (0.40) | none | Comparison |
| 115 | Y (0.05) | $A_1$ (0.30) | none | none | $F_1$ (0.30) | none | (0.30) | provided | $K_1$ (0.40) | none | Comparison |
| 116 | none | $A_1$ (0.30) | X (0.006) | none | $F_1$ (0.30) | none | (0.30) | provided | $K_1$ (0.40) | none | Comparison |
| 117 | none | $A_1$ (0.30) | Y (0.006) | none | $F_1$ (0.30) | none | (0.30) | provided | $K_1$ (0.40) | none | Comparison |
| 118 | X (0.05) | $A_2$ (0.30) | none | none | $F_1$ (0.30) | none | (0.30) | provided | $K_1$ (0.40) | none | Invention |
| 119 | Y (0.05) | $A_2$ (0.30) | none | none | $F_1$ (0.30) | none | (0.30) | provided | $K_1$ (0.40) | none | Invention |
| 120 | none | $A_2$ (0.30) | X (0.006) | none | $F_1$ (0.30) | none | (0.30) | provided | $K_1$ (0.40) | none | Invention |
| 121 | none | $A_2$ (0.30) | Y (0.006) | none | $F_1$ (0.30) | none | (0.30) | provided | $K_1$ (0.40) | none | Invention |
| 122 | X (0.05) | $A_2$ (0.30) | none | X (0.05) | $F_2$ (0.30) | none | (0.30) | omitted | $K_2$ (0.40) | none | Invention |
| 123 | Y (0.05) | $A_2$ (0.30) | none | Y (0.05) | $F_2$ (0.30) | none | (0.30) | omitted | $K_2$ (0.40) | none | Invention |
| 124 | none | $A_2$ (0.30) | X (0.006) | none | $F_2$ (0.30) | Y (0.006) | (0.30) | provided | $K_2$ (0.40) | Y (0.008) | Invention |
| 125 | Y (0.05) | $A_2$ (0.30) | none | Y (0.05) | $F_2$ (0.30) | none | (0.30) | omitted | $K_2$ (0.40) | none | Invention |

A plurality of strips were cut from the thus prepared Samples 101 to 125, wedgewise exposed through optical wedge using a halogen lamp having color temperature of 3200° K. as a light source and processed with the following standard color reversal developer (First Developer FD-S). Each strip was subjected to sensitometry with respect to each of cyan, magenta and yellow images. Further, for testing the processing stability, four strips cut from Samples 101 to 125 were wedgewise exposed in the same manner as above and processed with Developer FD-1, FD-2, FD-3 or FD-4 which was prepared from the first developer as a standard processing solution in the above-described color reversal processing by changing the amount of potassium thiocyanate and the amount of sodium sulfite as shown in Table 5. These strips were also subjected to sensitometry in the same manner as above. The results obtained are shown in Table 6.

TABLE 5

| Name of Chemicals | FD-S (g) | FD-1 (g) | FD-2 (g) | FD-3 (g) | FD-4 (g) |
|---|---|---|---|---|---|
| Potassium thiocyanate | 1.2 | 0.8 | 1.6 | 1.2 | 1.2 |
| Sodium sulfite | 30 | 30 | 30 | 20 | 40 |

TABLE 6

Processing Stability

| | Cyan Image | | | | | | Magenta Image | | | | | |
|---|---|---|---|---|---|---|---|---|---|---|---|---|
| | FD-1 FD-2 | | | FD-3 FD-4 | | | FD-1 FD-2 | | | FD-3 FD-4 | | |
| Sample | $\Delta S_1$ | $\Delta S_2$ | $\lvert\Delta S_1/\Delta S_2\rvert$ | $\Delta S_3$ | $\Delta S_4$ | $\lvert\Delta S_3/\Delta S_4\rvert$ | $\Delta S_1$ | $\Delta S_2$ | $\lvert\Delta S_1/\Delta S_2\rvert$ | $\Delta S_3$ | $\Delta S_4$ | $\lvert\Delta S_3/\Delta S_4\rvert$ |
| 101 | −0.25 | 0.20 | 1.25 | −0.20 | 0.16 | 1.25 | −0.23 | 0.18 | 1.28 | −0.18 | 0.14 | 1.29 |
| 102 | −0.25 | 0.20 | 1.25 | −0.25 | 0.20 | 1.25 | −0.24 | 0.20 | 1.20 | −0.19 | 0.16 | 1.19 |
| 103 | −0.25 | 0.20 | 1.25 | −0.26 | 0.21 | 1.24 | −0.24 | 0.21 | 1.14 | −0.19 | 0.16 | 1.19 |
| 104 | −0.25 | 0.20 | 1.25 | −0.24 | 0.20 | 1.20 | −0.22 | 0.18 | 1.22 | −0.17 | 0.14 | 1.21 |
| 105 | −0.25 | 0.20 | 1.25 | −0.25 | 0.20 | 1.25 | −0.22 | 0.17 | 1.29 | −0.18 | 0.14 | 1.29 |
| 106 | −0.26 | 0.20 | 1.30 | −0.21 | 0.17 | 1.24 | −0.28 | 0.30 | 0.93 | −0.26 | 0.21 | 1.24 |
| 107 | −0.26 | 0.21 | 1.24 | −0.22 | 0.17 | 1.29 | −0.30 | 0.35 | 0.86 | −0.29 | 0.27 | 1.07 |
| 108 | −0.27 | 0.21 | 1.24 | −0.21 | 0.18 | 1.17 | −0.29 | 0.31 | 0.94 | −0.28 | 0.22 | 1.27 |
| 109 | −0.26 | 0.21 | 1.24 | −0.22 | 0.18 | 1.22 | −0.31 | 0.36 | 0.86 | −0.31 | 0.27 | 1.15 |
| 110 | −0.23 | 0.19 | 1.21 | −0.19 | 0.16 | 1.19 | −0.15 | 0.15 | 1.00 | −0.13 | 0.12 | 1.08 |
| 111 | −0.24 | 0.19 | 1.26 | −0.18 | 0.15 | 1.20 | −0.16 | 0.15 | 1.07 | −0.14 | 0.14 | 1.00 |
| 112 | −0.23 | 0.20 | 1.15 | −0.19 | 0.17 | 1.12 | −0.16 | 0.16 | 1.00 | −0.14 | 0.12 | 1.17 |
| 113 | −0.24 | 0.20 | 1.20 | −0.19 | 0.16 | 1.19 | −0.17 | 0.16 | 1.06 | −0.15 | 0.14 | 1.07 |
| 114 | −0.33 | 0.39 | 0.85 | −0.27 | 0.31 | 0.87 | −0.24 | 0.19 | 1.26 | −0.19 | 0.16 | 1.19 |
| 115 | −0.35 | 0.43 | 0.81 | −0.31 | 0.23 | 1.35 | −0.25 | 0.20 | 1.25 | −0.20 | 0.16 | 1.25 |
| 116 | −0.34 | 0.40 | 0.85 | −0.30 | 0.34 | 0.88 | −0.24 | 0.20 | 1.20 | −0.20 | 0.18 | 1.11 |
| 117 | −0.36 | 0.45 | 0.80 | −0.33 | 0.35 | 0.94 | −0.26 | 0.21 | 1.24 | −0.21 | 0.17 | 1.24 |
| 118 | −0.18 | 0.19 | 0.95 | −0.16 | 0.17 | 0.94 | −0.22 | 0.17 | 1.29 | −0.17 | 0.16 | 1.06 |
| 119 | −0.19 | 0.19 | 1.00 | −0.17 | 0.17 | 1.00 | −0.21 | 0.17 | 1.24 | −0.17 | 0.13 | 1.31 |
| 120 | −0.20 | 0.19 | 1.05 | −0.17 | 0.18 | 0.94 | −0.22 | 0.18 | 1.22 | −0.18 | 0.16 | 1.13 |
| 121 | −0.21 | 0.19 | 1.11 | −0.18 | 0.18 | 1.00 | −0.22 | 0.19 | 1.16 | −0.18 | 0.15 | 1.20 |
| 122 | −0.18 | 0.19 | 0.95 | −0.16 | 0.16 | 1.00 | −0.15 | 0.15 | 1.00 | −0.13 | 0.13 | 1.00 |
| 123 | −0.18 | 0.19 | 0.95 | −0.16 | 0.16 | 1.00 | −0.16 | 0.15 | 1.07 | −0.14 | 0.13 | 1.08 |
| 124 | −0.20 | 0.19 | 1.05 | −0.16 | 0.17 | 0.94 | −0.16 | 0.16 | 1.00 | −0.15 | 0.15 | 1.00 |
| 125 | −0.19 | 0.19 | 1.00 | −0.17 | 0.17 | 1.00 | −0.16 | 0.16 | 1.00 | −0.14 | 0.14 | 1.00 |

| | Yellow Image | | | | | | |
|---|---|---|---|---|---|---|---|
| | FD−1 FD−2 | | | FD−3 FD−4 | | | |
| Sample | $\Delta S_1$ | $\Delta S_2$ | $\lvert\Delta S_1/\Delta S_2\rvert$ | $\Delta S_3$ | $\Delta S_4$ | $\lvert\Delta S_3/\Delta S_4\rvert$ | Remarks |
| 101 | −0.31 | 0.25 | 1.24 | −0.24 | 0.19 | 1.26 | Comparison |
| 102 | −0.33 | 0.41 | 0.80 | −0.26 | 0.28 | 0.93 | Comparison |
| 103 | −0.34 | 0.43 | 0.79 | −0.28 | 0.29 | 0.97 | Comparison |
| 104 | −0.22 | 0.22 | 1.00 | −0.17 | 0.16 | 1.06 | Invention |
| 105 | −0.21 | 0.22 | 0.95 | −0.17 | 0.17 | 1.00 | Invention |
| 106 | −0.32 | 0.25 | 1.28 | −0.24 | 0.20 | 1.20 | Comparison |
| 107 | −0.33 | 0.26 | 1.27 | −0.25 | 0.22 | 1.14 | Comparison |
| 108 | −0.33 | 0.25 | 1.32 | −0.24 | 0.21 | 1.14 | Comparison |
| 109 | −0.34 | 0.27 | 1.26 | −0.26 | 0.22 | 1.18 | Comparison |
| 110 | −0.31 | 0.26 | 1.19 | −0.24 | 0.20 | 1.20 | Invention |
| 111 | −0.32 | 0.26 | 1.23 | −0.25 | 0.20 | 1.25 | Invention |
| 112 | −0.32 | 0.26 | 1.23 | −0.25 | 0.20 | 1.25 | Invention |
| 113 | −0.33 | 0.27 | 1.22 | −0.25 | 0.20 | 1.25 | Invention |
| 114 | −0.31 | 0.25 | 1.24 | −0.24 | 0.19 | 1.26 | Comparison |
| 115 | −0.31 | 0.25 | 1.24 | −0.24 | 0.19 | 1.26 | Comparison |
| 116 | −0.31 | 0.26 | 1.19 | −0.24 | 0.19 | 1.26 | Comparison |
| 117 | −0.32 | 0.26 | 1.23 | −0.24 | 0.19 | 1.26 | Comparison |
| 118 | −0.31 | 0.25 | 1.24 | −0.24 | 0.19 | 1.26 | Invention |
| 119 | −0.31 | 0.25 | 1.24 | −0.24 | 0.19 | 1.26 | Invention |
| 120 | −0.31 | 0.25 | 1.24 | −0.24 | 0.19 | 1.26 | Invention |
| 121 | −0.31 | 0.25 | 1.24 | −0.24 | 0.19 | 1.26 | Invention |
| 122 | −0.21 | 0.22 | 0.95 | −0.17 | 0.16 | 1.06 | Invention |
| 123 | −0.21 | 0.22 | 0.95 | −0.17 | 0.16 | 1.06 | Invention |
| 124 | −0.22 | 0.23 | 0.97 | −0.17 | 0.17 | 1.00 | Invention |
| 125 | −0.22 | 0.22 | 1.00 | −0.17 | 0.17 | 1.00 | Invention |

Note 1: $\Delta S_1$ to $\Delta S_4$ each means the difference in logE values of the exposure amount (CMS unit) to give the minimum density + 0.5 for each image between the processing with First Developer FD-1, FD-2, FD-3 or FD-4 and the processing with standard First Developer FD-S.
Note 2: $\lvert\Delta S_1/\Delta S_2\rvert$ and $\lvert\Delta S_3/\Delta S_4\rvert$ represent an absolute value of the ratio of $\Delta S_1$ to $\Delta S_2$ and an absolute value of the ratio of $\Delta S_3$ to $\Delta S_4$, respectively.

Standard Processing

| Processing | Time (min.) | Temp. (°C.) | Tank Volume (l) | Replenishing Amount (ml/m$^2$) |
|---|---|---|---|---|
| First development | 6 | 38 | 12 | 2,200 |
| First washing | 2 | 38 | 4 | 7,500 |
| Reversal | 2 | 38 | 4 | 1,100 |
| Color development | 6 | 38 | 12 | 2,200 |
| Prebleaching | 2 | 38 | 4 | 1,100 |
| Bleaching | 6 | 38 | 12 | 220 |
| Fixing | 4 | 38 | 8 | 1,100 |
| Second washing | 4 | 38 | 8 | 7,500 |
| Final rinsing | 1 | 25 | 2 | 1,100 |

Each processing solution had the following composition.

| First Developer (FD-S) | Tank Solution (g) | Replenisher (g) |
|---|---|---|
| Pentasodium nitrilo-N,N,N-trimethylene phosphonate | 1.5 | 1.5 |
| Pentasodium diethylenetri-aminepentaacetate | 2.0 | 2.0 |
| Sodium sulfite | 30 | 30 |
| Potassium hydroquinone monosulfonate | 20 | 20 |
| Potassium carbonate | 15 | 20 |
| Potassium bicarbonate | 12 | 15 |
| 1-Phenyl-4-methyl-4-hydroxymethyl-3-pyrazolidone | 1.5 | 2.0 |
| Potassium bromide | 2.5 | 1.4 |
| Potassium thiosulfate | 1.2 | 1.2 |
| Potassium iodide | 2.0 mg | — |
| Diethylene glycol | 13 | 15 |
| Water to make | 1,000 ml | 1,000 ml |
| pH | 9.60 | 9.60 |

pH was adjusted with sulfuric acid or potassium hydroxide.

| Reversal Solution | Tank Solution (g) | Replenisher (g) |
|---|---|---|
| Pentasodium nitrilo-N,N,N-trimethylene phosphonate | 3.0 | same as tank solution |
| Stannous chloride dihydrate | 1.0 | |
| p-Aminophenol | 0.1 | |
| Sodium hydroxide | 8 | |
| Glacial acetic acid | 15 ml | |
| Water to make | 1,000 ml | |
| pH | 6.00 | |

pH was adjusted with acetic acid or sodium hydroxide.

| Color developer | Tank Solution (g) | Replenisher (g) |
|---|---|---|
| Pentasodium nitrilo-N,N,N-trimethylene phosphonate | 2.0 | 2.0 |
| Sodium sulfite | 7.0 | 7.0 |
| Trisodium phosphate dodecahydrate | 36 | 36 |
| Potassium bromide | 1.0 | — |
| Potassium iodide | 90 mg | — |
| Sodium hydroxide | 3.0 | 3.0 |
| Citrazinic acid | 1.5 | 1.5 |
| N-Ethyl-N-(β-methanesulfon-amidoethyl)-3-methyl-4-aminoaniline 3/2 sulfate monohydrate | 11 | 11 |
| 3,6-Dithiaoctane-1,8-diol | 1.0 | 1.0 |
| pH | 11.86 | 12.00 |

pH was adjusted with hydrochloric acid or sodium hydroxide.

| Prebleaching Solution | Tank Solution (g) | Replenisher (g) |
|---|---|---|
| Disodium ethylenediamine-tetraacetate dihydrate | 8.0 | 8.0 |
| Sodium sulfite | 6.0 | 8.0 |
| 1-Thioglycerol | 0.4 | 0.4 |
| Formaldehyde sodium bisulfite adduct | 30 | 35 |
| Water to make | 1,000 ml | 1,000 ml |
| pH | 6.30 | 6.10 |

pH was adjusted with acetic acid or sodium hydroxide.

| Bleaching Solution | Tank Solution (g) | Replenisher (g) |
|---|---|---|
| Disoduim ethylenediamine-tetraacetate dihydrate | 2.0 | 4.0 |
| Ammonium ethylenediamine-tetraacetato ferrate dihydrate | 120 | 240 |
| Potassium bromide | 100 | 200 |
| Ammonium nitrate | 10 | 20 |
| Water to make | 1,000 ml | 1,000 ml |
| pH | 5.70 | 5.50 |

pH was adjusted with nitric acid or sodium hydroxide.

| Fixing Solution | |
|---|---|
| Ammonium thiosulfate | 80 g |
| Sodium sulfite | 5.0 g |
| Sodium bisulfite | 5.0 g |
| Water to make | 1,000 ml |
| pH | 6.60 |

pH was adjusted with acetic acid or aqueous ammonia.

| Stabilizing Solution | |
|---|---|
| Formalin (37%) | 5.0 ml |
| Polyoxyethylene-p-monononyl-phenyl ether (polymerization degree: 10) | 0.5 ml |
| Water to make | 1,000 ml |

In order to compare the color reproducibility of each sample to the transparent original, the same transparent original was printed on each sample. The transparent original used was a color slide obtained from a Fuji chrome professional reversal film (RDP, produced by Fuji Photo Film Co., Ltd.).

Color differences were examined on the points in a definite straight line section of the original and in the corresponding definite straight line section of each print and values on several representative points are shown in Table 7. The color differences used were color differences by L*a*b* chromaticity diagram.

In Table 7, color differences on the determination points a to g of each sample corresponding to the determination points a to g of the transparent original are shown. In these determination points, the following images are printed in practice.

a: black background, b: gray chart, c: red flower petal, d: leaf, e: blue book, f: highlight portion of a face, and g: shadow portion of a face.

TABLE 7

| | Color Reproducibility | | | | | | | |
|---|---|---|---|---|---|---|---|---|
| | Color Difference (smaller value indicates better color reproducibility) | | | | | | | |
| Sample | a | b | c | d | e | f | g | Remarks |
| 101 | 5.3 | 6.1 | 11.4 | 13.7 | 9.8 | 5.3 | 4.7 | Comparison |
| 102 | 3.8 | 5.5 | 10.1 | 12.8 | 5.3 | 3.8 | 2.5 | Comparison |
| 103 | 3.9 | 5.5 | 10.2 | 12.8 | 5.4 | 4.0 | 2.6 | Comparison |
| 104 | 3.9 | 5.4 | 10.3 | 12.9 | 5.8 | 4.0 | 2.6 | Invention |
| 105 | 4.0 | 5.5 | 10.3 | 13.0 | 5.7 | 4.1 | 2.7 | Invention |
| 106 | 3.7 | 5.4 | 10.2 | 8.4 | 7.7 | 3.9 | 2.5 | Comparison |
| 107 | 3.4 | 5.1 | 9.9 | 7.9 | 7.4 | 3.8 | 2.3 | Comparison |
| 108 | 3.8 | 5.3 | 10.1 | 8.6 | 7.6 | 3.7 | 2.6 | Comparison |
| 109 | 3.5 | 5.1 | 10.0 | 8.2 | 7.5 | 3.9 | 2.4 | Comparison |
| 110 | 3.8 | 5.5 | 10.4 | 8.7 | 7.9 | 4.0 | 2.6 | Invention |
| 111 | 3.5 | 5.2 | 10.0 | 8.1 | 7.6 | 3.9 | 2.4 | Invention |
| 112 | 3.7 | 5.6 | 10.1 | 8.5 | 7.7 | 3.9 | 2.5 | Invention |
| 113 | 3.6 | 5.3 | 10.1 | 8.2 | 7.8 | 3.8 | 2.5 | Invention |
| 114 | 3.7 | 5.5 | 8.3 | 11.8 | 7.8 | 4.9 | 3.8 | Comparison |
| 115 | 3.5 | 5.3 | 7.9 | 11.5 | 7.5 | 4.7 | 3.5 | Comparison |
| 116 | 3.6 | 5.4 | 8.2 | 11.7 | 7.9 | 5.0 | 3.9 | Comparison |
| 117 | 3.5 | 5.4 | 8.0 | 11.4 | 7.6 | 4.9 | 3.6 | Comparison |
| 118 | 3.8 | 5.6 | 8.4 | 12.0 | 7.9 | 5.1 | 2.8 | Invention |
| 119 | 3.6 | 5.5 | 8.1 | 11.6 | 7.7 | 3.8 | 2.5 | Invention |
| 120 | 3.8 | 5.7 | 8.3 | 12.1 | 7.8 | 5.0 | 2.7 | Invention |
| 121 | 3.6 | 5.6 | 8.1 | 11.7 | 7.8 | 3.7 | 2.6 | Invention |
| 122 | 2.3 | 5.0 | 7.6 | 8.0 | 6.0 | 3.1 | 2.8 | Invention |
| 123 | 1.7 | 3.8 | 7.4 | 7.7 | 5.1 | 2.6 | 2.5 | Invention |
| 124 | 1.5 | 2.7 | 7.1 | 7.6 | 4.8 | 2.6 | 2.4 | Invention |
| 125 | 1.4 | 2.6 | 7.0 | 7.4 | 4.7 | 2.5 | 2.3 | Invention |

From Tables 6 and 7, it is seen that as compared with Sample 101, Samples 102, 103, 106 to 109 and 114 to 117 has superior color reproducibility however underwent deterioration in processing stability. On the other hand, samples of the present invention exhibited superior color reproducibility and at the same time good processing stability. Further, upon comparison between samples 110 and 111, between samples 112 and 113, between samples 118 and 119 and between 120 and 121, still better color reproducibility could be achieved by using yellow colloidal silver.

In conclusion, samples of the present invention can be said to provide superior color reproducibility and good processing stability.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having provided thereon at least one blue-sensitive emulsion layer, at least one green-sensitive emulsion layer and at least one red-sensitive emulsion layer, wherein at least one emulsion layer in any one of the color-sensitive layers contains a silver halide grain having incorporated therein a rhodium ion and wherein said at least one emulsion layer or a layer adjacent to said at least one emulsion layer contains a silver halide emulsion comprising (i) inside and/or surface fogged substantially light-insensitive grains or (ii) colloidal silver.

2. The silver halide color photographic material as claimed in claim 1, wherein a layer containing a silver halide grain having incorporated therein a rhodium ion and containing a silver halide emulsion comprising (i) inside and/or surface fogged substantially light-insensitive grains or (ii) colloidal silver is the lowest-sensitivity emulsion layer in said color-sensitive layer.

3. The silver halide color photographic material as claimed in claim 1, wherein said silver halide emulsion comprises colloidal silver having a maximum absorption wavelength of from 400 nm to 500 nm.

4. The silver halide color photographic material as claimed in claim 1, wherein the blue-sensitive emulsion layer, the green-sensitive emulsion layer and the red-sensitive emulsion layer each is composed of at least three emulsion layers having different sensitivities.

5. The silver halide color photographic material as claimed in claim 1, wherein a layer containing a silver halide grain having incorporated therein a rhodium ion and containing a silver halide emulsion comprising (i) inside and/or surface fogged substantially light-insensitive grains or (ii) colloidal silver, is provided adjacent to the lowest-sensitivity emulsion layer in said color-sensitive layer.

* * * * *